United States Patent [19]

Scheck

[11] 4,078,956

[45] Mar. 14, 1978

[54] METHOD AND APPARATUS FOR DIE CUTTING AT LEAST ONE BLANK IN A SHEET

[75] Inventor: Paul Scheck, Prilly, Switzerland

[73] Assignee: J. Bobst & Fils, S.A., Switzerland

[21] Appl. No.: 594,237

[22] Filed: Jul. 9, 1975

[30] Foreign Application Priority Data

Jun. 16, 1974 Switzerland ..... 009811/74

[51] Int. Cl.[2] ..... B31B 1/16; B26D 7/18; B31B 1/86

[52] U.S. Cl. ..... 156/157; 93/1 G; 93/36 A; 93/58 R; 156/257; 156/502; 156/505; 156/570; 271/33

[58] Field of Search ..... 156/157, 250, 257, 258, 156/264, 267, 502, 505, 506, 507, 510, 513, 516, 545, 563, 566, 570, 581, 559; 93/1 F, 1 G, 36 R, 36 A, 36 M, 36.6, 58 R, 58.3; 229/69; 271/33

[56] References Cited

U.S. PATENT DOCUMENTS

| | | | |
|---|---|---|---|
| 2,930,427 | 3/1960 | Fillmann et al. | 156/157 |
| 3,562,045 | 2/1971 | Hasegawa | 156/304 |
| 3,653,304 | 4/1972 | Lenoir | 93/36 A |
| 3,658,220 | 4/1972 | Norton | 93/36 A |
| 3,807,610 | 4/1974 | Mueller | 93/36 A |
| 3,824,143 | 7/1974 | Cooper et al. | 156/545 |
| 3,844,201 | 10/1974 | Eggert et al. | 93/36 A |
| 3,850,778 | 11/1974 | Gnage | 156/502 |
| 3,870,213 | 3/1975 | Meylan | 225/100 |

*Primary Examiner*—William A. Powell
*Assistant Examiner*—John E. Kittle
*Attorney, Agent, or Firm*—Hill, Gross, Simpson, Van Santen, Steadman, Chiara & Simpson

[57] ABSTRACT

A method and apparatus for die cutting at least one blank in a sheet and stripping waste material therefrom, characterized by forming a band of interconnected individual sheets by positioning the leading edge of the sheet in alignment with the trailing edge of the last sheet in the band, interconnecting the edges and then intermittently conveying the band of interconnected sheets through a platen press with a dwell for die cutting, followed by a dwell in a stripper station for removing waste and then separating the die cut sheet prior to transfer to a delivery station for subsequent handling. In the preferred embodiments, the separating of the sheets can be accomplished subsequent to the stripping of the waste material or during the stripping operation. To intermittently transport the sheet to the various stations, a drive roll is connected by a oneway clutch to an oscillating sector gear which is preferably disposed at the input side of the die cutting station and at the output side a tensioning device is utilized to maintain the sheet in tension during the dwell period in which a die cutting operation is performed.

32 Claims, 18 Drawing Figures

72
77
74
76
74
75
78
79
70
80
60
91
92
87
63
67
71
69
65
61
VI
66
103
105
102
106
97
107
86
101
64
85
67
68
16
40
39
38
VI 72
74
76
77
79
III
V
60
94
70
92
91
87
81
63
71
89
62
61
65
102
100
103
106
107
105
97
99
98
100
113
108
64
112
101
82
83
VI
III

Fig. 6
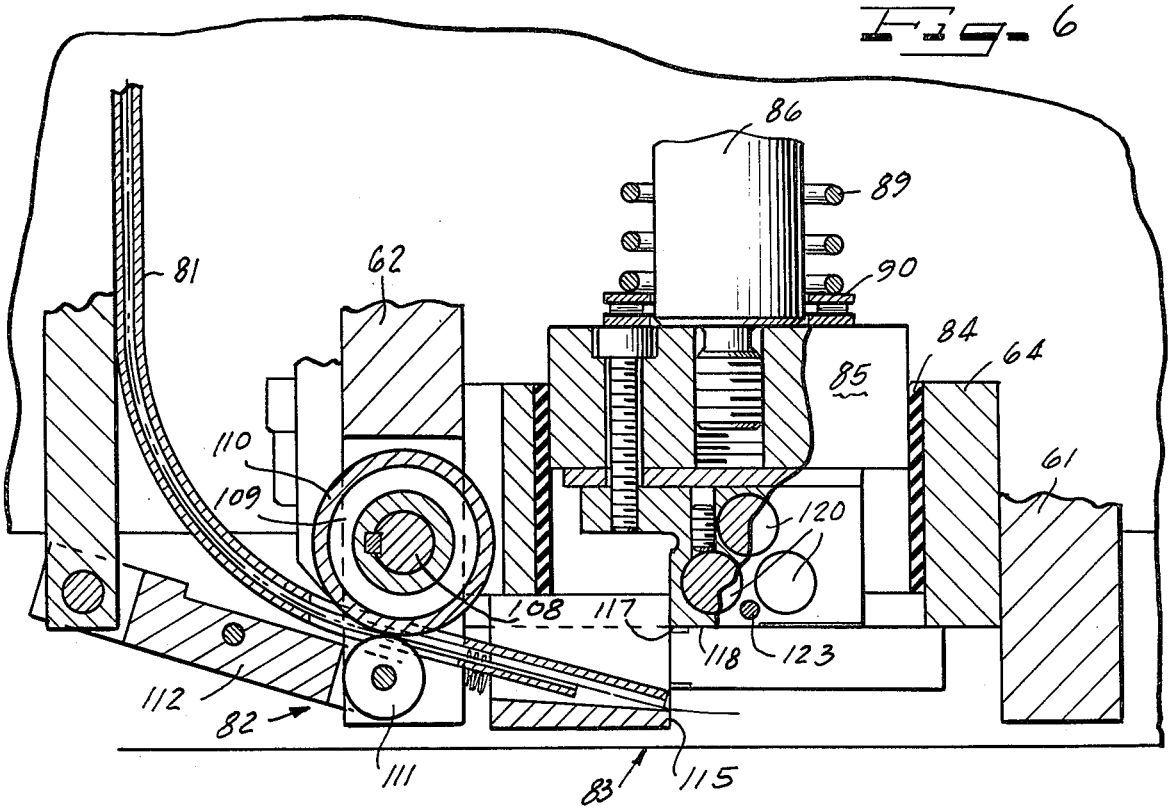
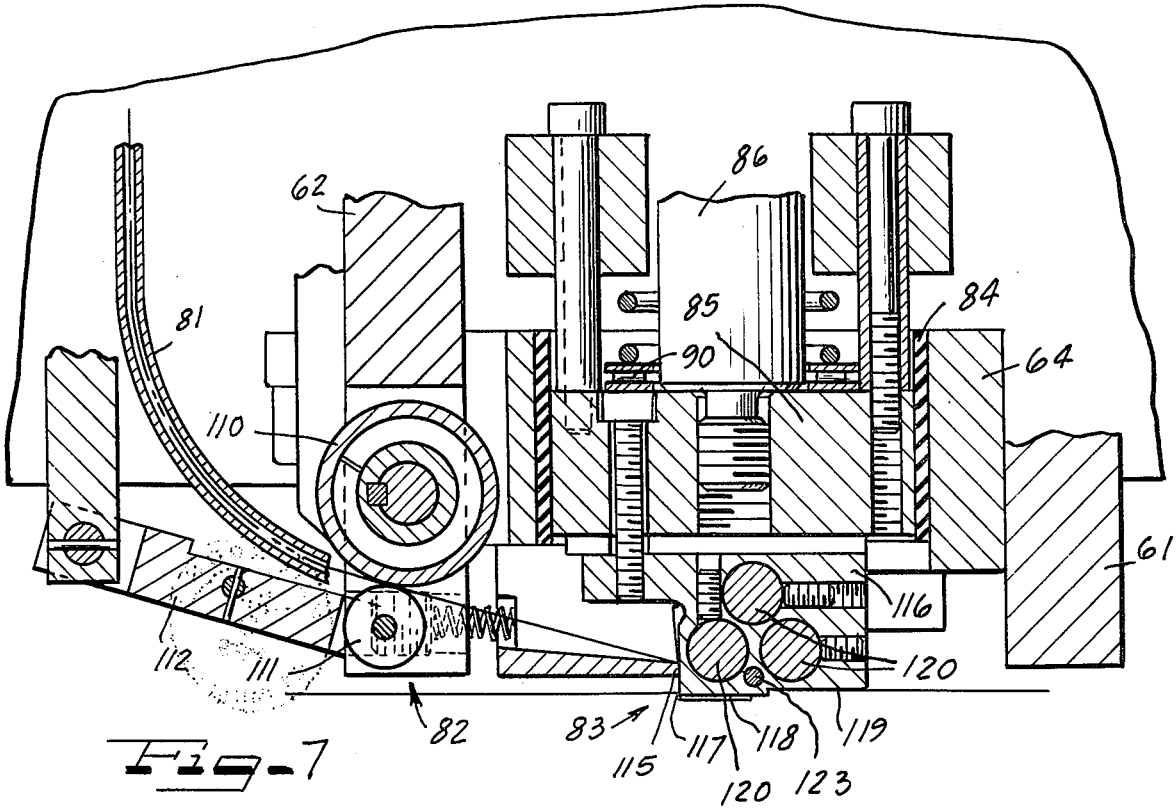
Fig. 7

METHOD AND APPARATUS FOR DIE CUTTING AT LEAST ONE BLANK IN A SHEET

BACKGROUND OF THE INVENTION

1. Field of the Invention

The present invention is directed to a method and apparatus for die cutting at least one blank in a sheet and stripping waste material therefrom.

2. Prior Art

Conventional die cutting apparatus utilizes a conventional platen press having a pair of platens provided with knives and creasing bars for cutting and creasing blanks from a sheet of material such as pasteboard, a stripping station in which waste portions are stripped from the sheet, and a delivery station in which the stripped sheet is discharged for subsequent handling. To transport a workpiece or sheet between the platens and then to the other station, the conventional apparatus has a conveying device comprising a pair of spaced endless chains with gripper bars disposed thereon. The gripper bar grasps the leading edge of a sheet as it is introduced to the apparatus and intermittently transports the sheet through the apparatus and the conveyor provides a dwell period for the sheet at each station to enable the performance of an operation thereon.

Conventional presses have exhibited several disadvantages. Among these is a high sound or noise level of the machine, the relatively low operational speed, a danger presented by a gripper bar being misaligned during operation of the machine and the complexity of the actuating means for intermittently advancing the gripper bars of the conveyor device through the device.

SUMMARY OF THE INVENTION

The present invention provides a method and an apparatus for die cutting at least one blank in a sheet of material with a platen press and sequentially removing waste material from the die cut sheets without requiring the utilization of a conveying device having gripper bars on a pair of conveyor chains. To accomplish this task, the apparatus includes a platen press having a pair of platens, a stripper station and delivery station all aligned to sequentially perform their respective operations on a sheet of material as it is transported through the apparatus, means for forming a band of interconnected sheets with the leading edge of each sheet connected to the trailing edge of the preceeding sheet, means for intermittently conveying the band of sheets through the platen press and the stripping station with a dwell period to enable die cutting each sheet positioned between the platens and stripping waste from the die cut sheet which is positioned at the stripping station and means for sequentially separating each of the sheets from the band prior to being received by the delivery station. To form the band of sheets, means are provided for producing a flow of overlapping shingled sheets, means for positioning the first sheet of the flow in alignment with the trailing edge of the last sheet in the band and means for interconnecting the aligned edges together. Preferably, the apparatus includes means for tensioning a sheet disposed between the platens and this means in the preferred embodiment comprises a pressure roll coacting with a drive roll which is continuously driven and means for varying the pressure exerted by the pressure roll so that during a dwell period, a minimum pressure is applied to a sheet and the drive roll exerts a tension thereon and during a conveying period, the drive roll coacts with the pressure roll to move the band forward. In one embodiment of the apparatus and the method, the separating is accomplished by separating means spaced from the stripping station and arranged to receive the band of sheets after passing through the stripping station. In another embodiment, the separating means is arranged in the stripping station so that stripping and separating of the sheets occurs simultaneously.

BRIEF DESCRIPTION OF THE DRAWINGS

FIG. 6 is an enlarged cross section with portions in elevation for purposes of illustration taken along line VI—VI of FIG. 3;

FIG. 7 is a view similar to FIG. 6;

DESCRIPTION OF THE PREFERRED EMBODIMENTS

Figure 1A:
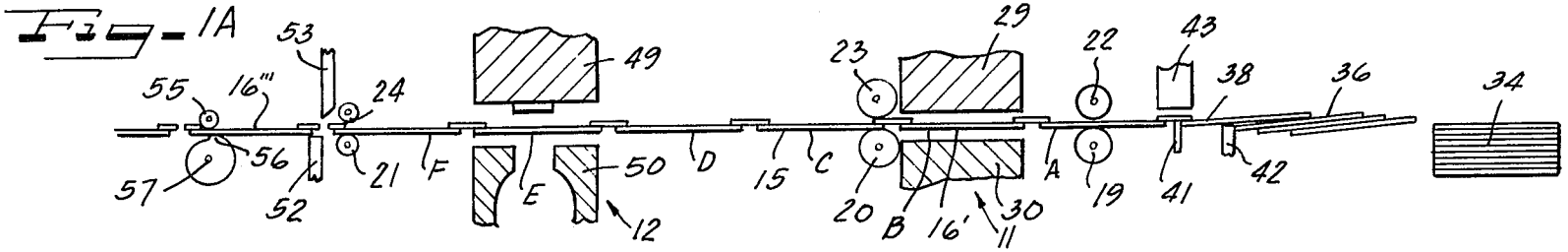
FIG. 1A and 1B diagrammatically illustrate the operations of one embodiment of the present invention.

The principles of the present invention are particularly useful in an apparatus or device generally indicated at 10 (FIG. 2) which die cuts and creases one or more blanks from a sheet of material, and then subsequently strips waste portions from the die cut sheet.

The apparatus or device 10 has a platen press 11 forming a die cutting station, a stripping station 12 and a delivery station 13 which are all illustrated as being mounted on a frame 14 of the device. To form a band or web 15 (FIGS. 1A and 1B) of interconnected sheets 16, the apparatus 10 includes means 17 (FIG. 2) for forming the web or band. To convey the band 15 through the various stations, the apparatus 10 includes a plurality of drive rolls such as 19, 20 and 21 with the drive roll 19 coacting with at least one pressure roll 22, the drive roll 20 coacting with at least one pressure roll 23 and at least one pressure 24 coacting with the drive roll 21. To separate or disassemble the individual sheet of blanks from the continuous band 15, separating means or disassembly means such as a guillotine or cross-cutter generally indicated at 25 (FIG. 2) is mounted on the frame 14 in a position to act on the band 15 after it has passed through the stripping station 12. The separated sheet of blanks is then received by a transporting device 26 which is mounted on the frame 14 and which moves the separated sheet stream-wise to the delivery station 13. The delivery station 13 is illustrated as having a belt such as an overhead suction belt which conveys the sheet to a position for being deposited on a stack or pile 27.

The platen press 11 has an upper platen 29 and a lower platen 30 which are reciprocated together with one of the platens being provided with a plurality of cutting knives and creasing bars or members to die cut and provide creases or fold lines in a sheet disposed between the platens. The press 11 may be a conventional platen press in which the upper platen 29 is stationary and the lower platen 30 which carries the pattern of knives and creasing bars is reciprocated relative to the upper platen 29 to cut a sheet disposed between the platens.

The stripping station 12 has a template and an array of stripping pins coacting with opening in a template to strip undesirable or waste portions from the die cut sheet disposed therebetween. Mechanical linkage (not illustrated) actuates the stripping station 12 and the platen 11 so that both stations perform these functions during a dwell period of the conveyor means.

To introduce individual sheets to the means 17, a feeding device 33 of a conventional structure feed sheets from a stack 34 of sheets onto a feed table 35 as a flow 36 of sheets with the sheets being in a shingled and overlapping relationship. Thus, the means 17 for forming the band 15 includes the means providing a flow such as 36 on the feed table 35 in which the sheets are in overlapping, shingled relationship as best illustrated in FIG. 1A. The means for forming the band 15 of interconnected sheets 16 has means for positioning a leading sheet 38 of the flow 36 with its leading edge 39 in alignment and spaced from a trailing edge 40 of the last sheet of the band 15. To ensure alignment and the proper position for the leading edge 39, it is moved against at least one abutment 41 and a lateral edge of the sheet 38 is moved against a lateral abutment or stop 42. With the sheet 38 in a proper alignment with the trailing edge 40, the means 17 includes means for interconnecting which is schematically illustrated at 43 and which applies connecting elements such as 44 to interconnect the sheets across the aligned edges 39 and 40.

The band 15 of interconnected sheet is incrementally advanced through the various stations by the drive roll 19 which is incrementally driven to advance the band a predetermined distance such as the length of one sheet 16. On the outlet side of the platens 29 and 30 the drive roll 20 engages the band 15 and applies a tensioning force to the blanks such as 16' disposed between the platens to maintain the desired alignment with respect to the knives and creasing bars.

At the completion of the die cutting and creasing operation performed by the platens 29 and 30, the sheet 16' is provided with a plurality of blanks such as 45. The die cut sheet 16' also has a plurality of waste portions 46, a marginal leading edge waste portion 47 and trailing edge portion 48.

Continued movement of the band 15 by the conveying means moves the die cut sheet 16' to the stripping station 12 which is schematically illustrated as having a member 49 supporting pins and a template 50. The template and the coacting pins are positioned to remove the waste portion 46 from the die cut sheet 16' to form stripped sheet 16''.

Subsequent to the stripping operation, the stripped sheet 16'' is subsequently conveyed and fed to the guillotine or crosscutter 25, which includes the drive roll 21 and the pressure roll 24. The guillotine 25 has a fixed knife 52 and a movable knife 53 and the feeding of the band 15 positions the connecting elements in the cutting axis of the knives. When the movable knife 53 is reciprocated to cut the connecting elements 44, the sheet 16''' is separated from the band 15. As illustrated, when severed from the band 15, the sheet 16''' has its leading edge inserted in a transporting device or means 26 which includes a pressure roll 55 and a drive segment 56 which is carried on a shaft 57 and which will engage the sheet 16''' and convey it into the delivery means 13.

Figure 1B:
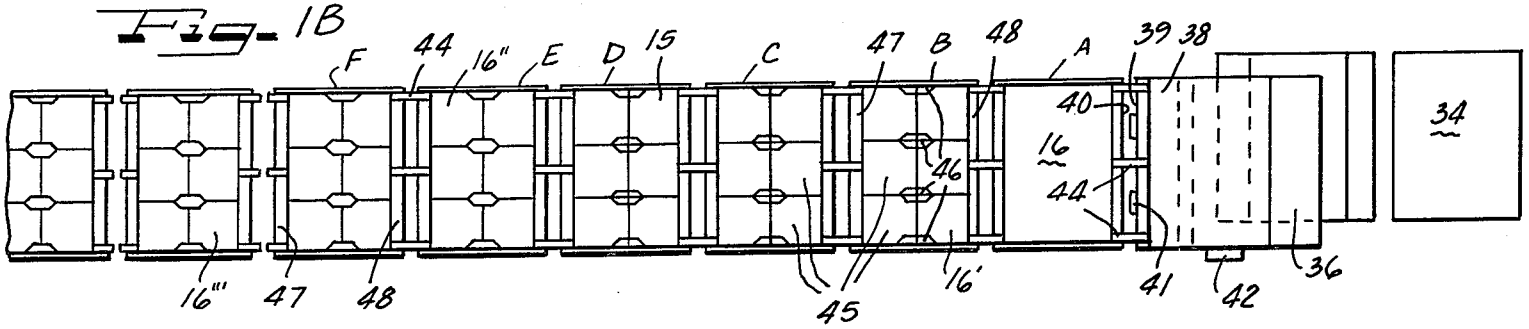

In the arrangement illustrated in FIGS. 1A and 1B, the stack 27 receives the sheets 16''' which still have the leading marginal waste portion 47 and the trailing edge waste portion 48. The stack 27 of the blanks 16''' are removed from the apparatus 10 and subsequently processed to separate the individual blanks 45 for further processing into a product such as a carton.

During initial formation of the band 15, a sheet 16 is aligned in a position A (FIGS. 1A and 1B), which is at the entrance of the platens 29, 30, and the leading sheet 38 of the flow 36 has its edge 39 aligned with the trailing edge 40 of the sheet in position A. After connecting the sheet 38 to the sheet in position A, the sheet in position A is advanced to position B which is between the platens 29 and 30 and the sheet 38 assumes position A. As the sheet in position B is die cut, the next leading sheet of flow 36 is aligned and attached to the trailing edge of the sheet in position A. After the die cutting of the sheet in position B, the band 15 is advanced with the die cut sheet 16' moving to a position C, and the sheet in position A moving to position B. After each die cutting of a sheet at position B and the connecting of an additional sheet to the trailing edge of the sheet at position A, the band 15 is advanced with the leading sheet of the band moving sequentially in a step-like manner through positions D, E and F. During the initial formation of the band 15 and until the leading sheet of the band reaches position F, some manual handling may be required; however, once the leading sheet of the band reaches position F, the subsequent step-like advancing of the web or band 15 of sheets 16 will be accomplished by the drive roll 19.

The interconnecting means 43 which applies the connecting element 44 may be a stapling device to apply a staple or wire connecting element. An illustrative embodiment of a means for interconnecting the sheets by applying a connecting element is illustrated in FIGS. 3–7 as a taping device generally indicated at 60.

Figure 4:
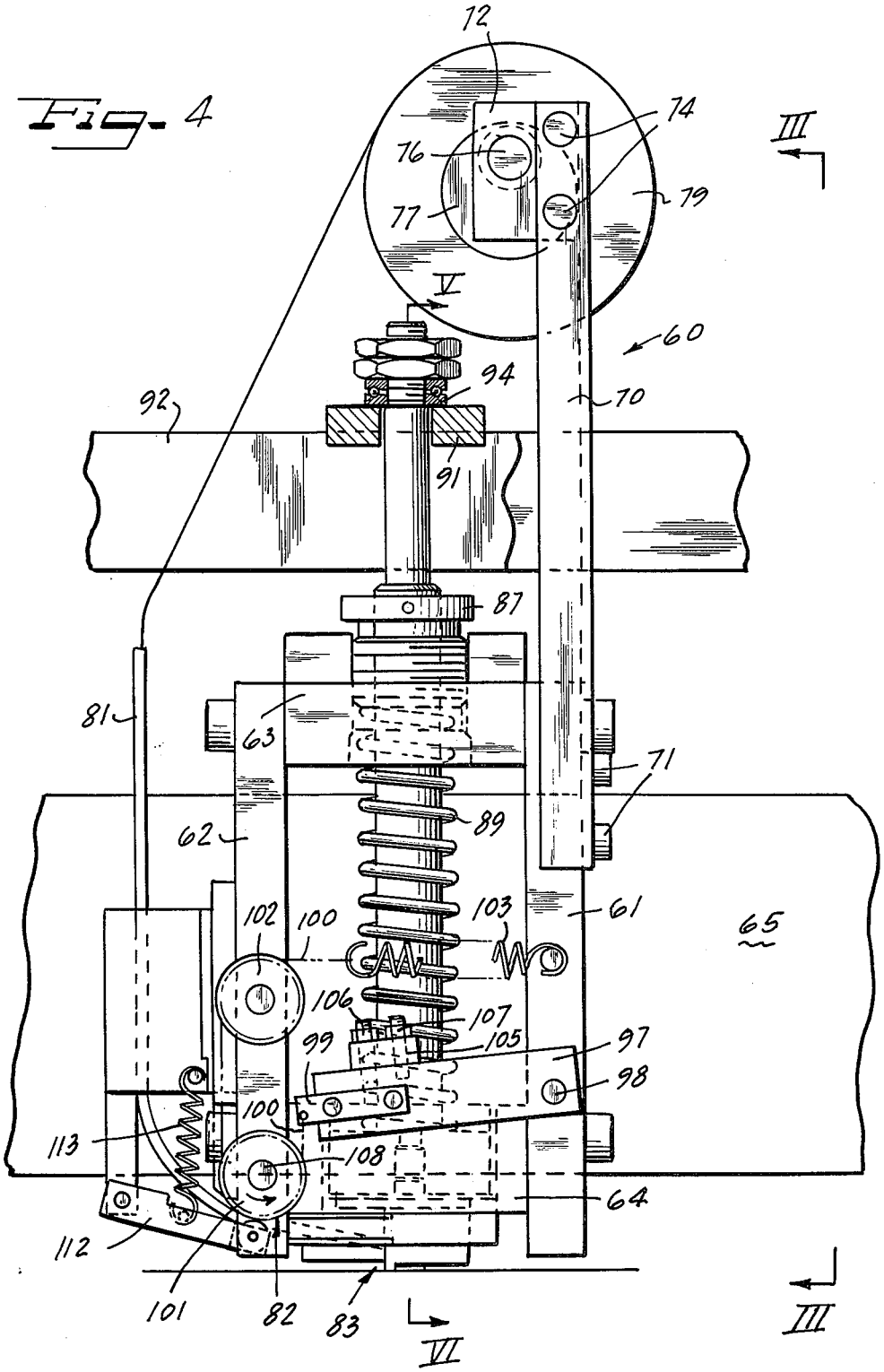
FIG. 4 is a side view of the device of FIG. 3.

The taping device 60 as best illustrated in FIG. 4 has a hollow body formed by a pair of spaced members or plates 61, 62, which are spaced apart by an upper block 63 and a lower block 64. The body is adjustably mounted on a transverse member 65 of the frame 14 of the apparatus 10 by a bar 66, which is threadably attached to the body threaded fasteners such as 67, 67. To insure proper vertical position of the body over the sheets 16 and 38, the lower member 64 has a tab 68, which forms a shoulder for engaging a lower surface of the transverse member 65, and the upper body or block 63 is provided with a setscrew 69, which engages the upper surface of the transverse member 65.

A support 70 is attached, such as by machine screws 71, to one plate 61 and extends upward to support a plate 72, which is attached by fastening means, such as machine screws 74. A shaft 75 is affixed on the plate 72 by a fastening means, such as by machine screws 76. The shaft 75 is provided with a pair of flanges 77 and 78, which position a roll or reel 79 of thermo-adhesive paper or tape 80. When the tape 80 is peeled from the reel 79, the tape 80 extends into a tape guide 81, which guides it through means 82 for advancing an incremental amount of tape to a tape cutting and applying means generally indicated at 83.

Figure 5:
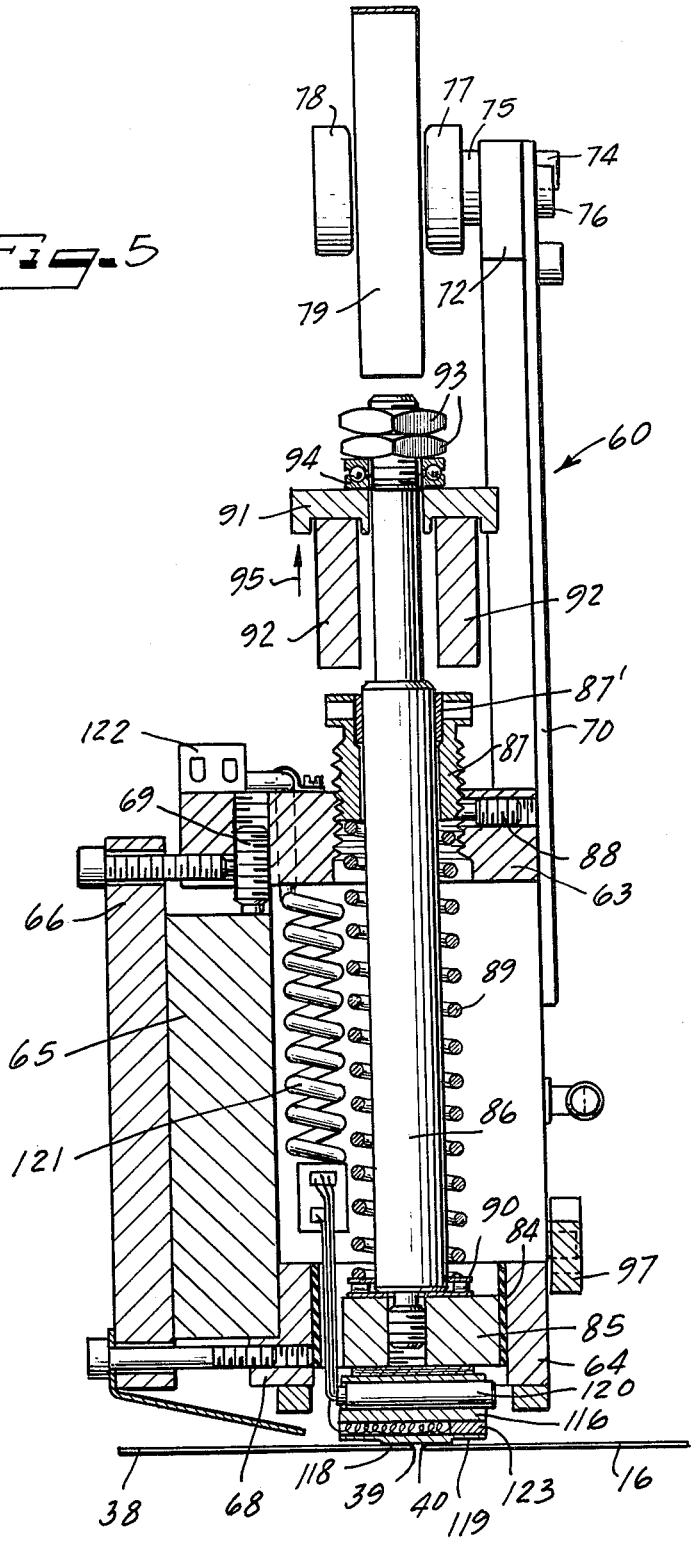
FIG. 5 is a cross-sectional view taken along line V—V of FIG. 4.

The lower member 64 has an axial bore, which is provided with a bushing 84 of self-lubricating material, and a piston 85, which is threadably connected to a rod 86, is disposed in the bushing 84. The rod 86 extends through an adjustable bushing 87, which is threaded into the upper member 63 and held by set-screw 88. The bushing 87 is provided with a self-lubricating liner or bushing 87'. A spring 89 is telescopically received on rod 86 and entrapped between the adjustable bushing 87 and a needle thrust bearing 90, which rests on an upper surface of the piston 85. The force of the entrapped spring 89 biases the piston 85 away from the sleeve nut 87 towards the pair of sheets 16 and 38 (FIG. 5).

An upper end of the shaft 86, which extends through the sleeve nut 87, extends through an aperture in a keeper plate or strap 91, which is supported on a pair of movable transverse members 92,92. To retain the strap 91, the end of the rod 86 receives nuts 93, which entrap a ball thrust bearing 94 between the member 91 and the nuts. When the transverse members 92,92 move in an upward direction of the arrow 95, they shift the piston 85 in an upward direction against the biasing force of the spring 89. As the members 92 resume the illustrated position, the spring biases the piston to the lower position, which may be adjusted by changing the axial position on the nuts 93 on the rod 86.

The means 82 for advancing a discrete length of tape 80 includes a rocker arm or lever 97 (FIG. 4), which is pivotably connected at 98 on plate 61 and has an anchor 99 attached to the free end. A sprocket chain 100 is connected to the anchor 99 and passes around a first sprocket gear 101, which is mounted for rotation on the member 62, and around a second sprocket gear 102, which is disposed on the member 62 above the gear 101. The opposite end of the chain is connected to a spring 103, which is anchored on the member 61.

Figure 3:
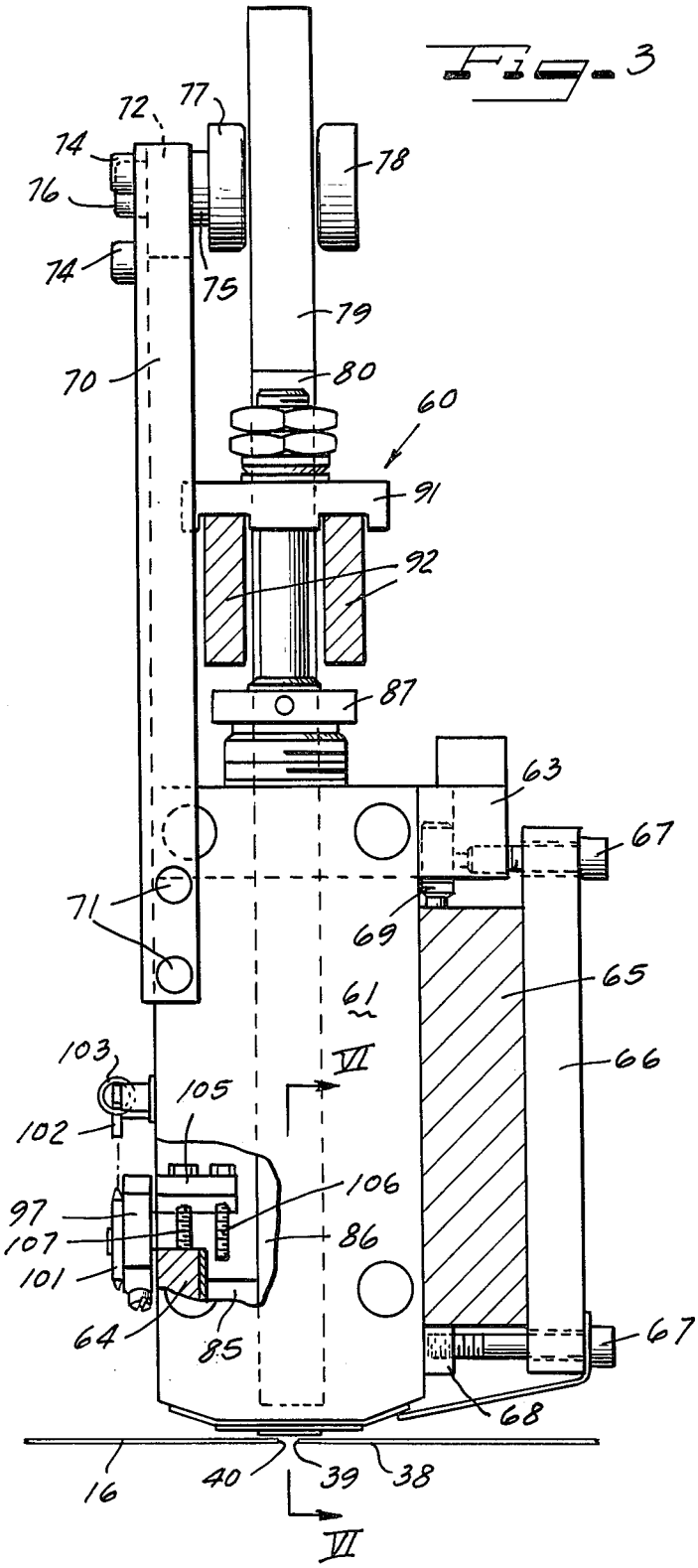
FIG. 3 is an end view taken from line III—III of FIG. 4 and with portions broken away for purposes of illustration of a device for interconnecting the sheets into a band of sheets.

To pivot the lever 97 about its pivot point 98, a plate 105 is secured thereon and is provided with adjustable abutments 106 and 107, which are illustrated as threaded member. As illustrated in FIG. 3, the member 106 is disposed above the piston 85 and will be engaged by an upper surface of the piston 85 after the piston has been lifted beyond a given axial position in the sleeve 84 so that the piston 85 will move the lever 97 in a clockwise direction. The stop member 107 engages an upper surface of the member 64 and limits the downward or counterclockwise movement of the lever arm 97 as the piston 85 moves toward its lowermost position. As the piston 85 is lifted and moves the lever 97 in a clockwise direction, the movement of the chain 100 causes a counterclockwise rotation of the sprocket 101. The stops 106 and 107 can be adjusted to produce the desired amount of pivotable movement of the lever 97 during each reciprocation of the piston 85 and to control the time of the movement during each stroke of the piston.

As best illustrated in FIGS. 6 and 7, the sprocket 101 is mounted on a shaft 108, which is connected by a one-way drive 109, such as a one-way clutch, to a drive roll 110. The one-way clutch 109, which can be a conventional design, transfers counterclockwise movement of sprocket 101 and its respective shaft 108 to the drive roll 110, which engages the tape 80 and coacts with the pressure roll 111, which is carried on a pivotable arm 112. A spring 113 (FIG. 4) biases the arm 112 to hold the pressure roll 111 against the drive roll 110. During each upward movement of the bars or members 92, the drive roll 110 is rotated in a counterclockwise direction for a discrete distance to pull off and dispense a discrete length of tape 80 passed a fixed cutting edge 115, which is mounted on a lower surface of the member 64. The amount of tape 80 dispensed during each stroke is dependent on the size of the angle through which the lever 97 moves.

A block 116 is detachably connected on a bottom surface of the piston 85 and has a cutting edge 117, which is formed by a lower surface 118 and which coacts with the cutting edge 115. As best illustrated in FIGS. 5 and 7, the surface 118 projects passed the remaining lower surface 119 of the block 116. The block 116 is provided with three transversely extending bores with each bore receiving an electrical heating element 120. The elements 120 are connected to a source of power by an electrical cable 121, which extends to a terminal or socket 122 (FIG. 5). Adjacent the lower surface 118, the block 116 has a small transverse bore, which receives a sensor 123 for sensing the temperature of the block. The sensor 123 is connected to a control which in response to the sensed temperature controls the operation of the heating elements 120 to maintain the block and surface 118 at the desired temperature level.

As best illustrated in FIG. 7, when the piston 85 reaches its lowermost position, a fixed amount of tape 80 was cut by the coaction of the movable knife 117 and the fixed knife 115, and the lower surface 118 heats and presses the tape onto the upper surfaces of the sheets 16 and 38 adjacent the edges 39 and 40 to form a connection between the sheets. During upward movement of the piston 85 to the position illustrated in FIG. 6 and after the block 116 clears the fixed knife 115, a new length of tape is conveyed passed the fixed knife edge 115. The adjustable abutments 106 and 107 on the lever 97 are set so that the movement of the lever 97 will commence after the knife edge 117 has cleared the fixed knife edge 115. Due to the orientation of the applying unit 60, the length of tape, which is applied as the connecting element 44, extends parallel to the aligned edges 39 and 40. If three connecting elements are utilized as shown in FIG. 1B, then three applying units 60 are spaced on the transverse member 65 to apply the connecting tape at the desired positions on the band. Since each of the units is adjustably mounted on the transverse member 65, its position can be adjusted to compensate for both changes in the width of the sheet and changes in the desired location of the connecting elements 44.

As mentioned above, the leading sheet 38 of the flow 36 while moving on the feed table 35 is positioned in correct alignment relative to the trailing edge 40 of the sheet 16. To obtain this alignment, at least one forward abutment 41 and one side abutment or lateral abutment 42 is utilized. An electrical sensing device (not illustrated) may be provided to determine if the accurate alignment has been obtained.

Figure 8:
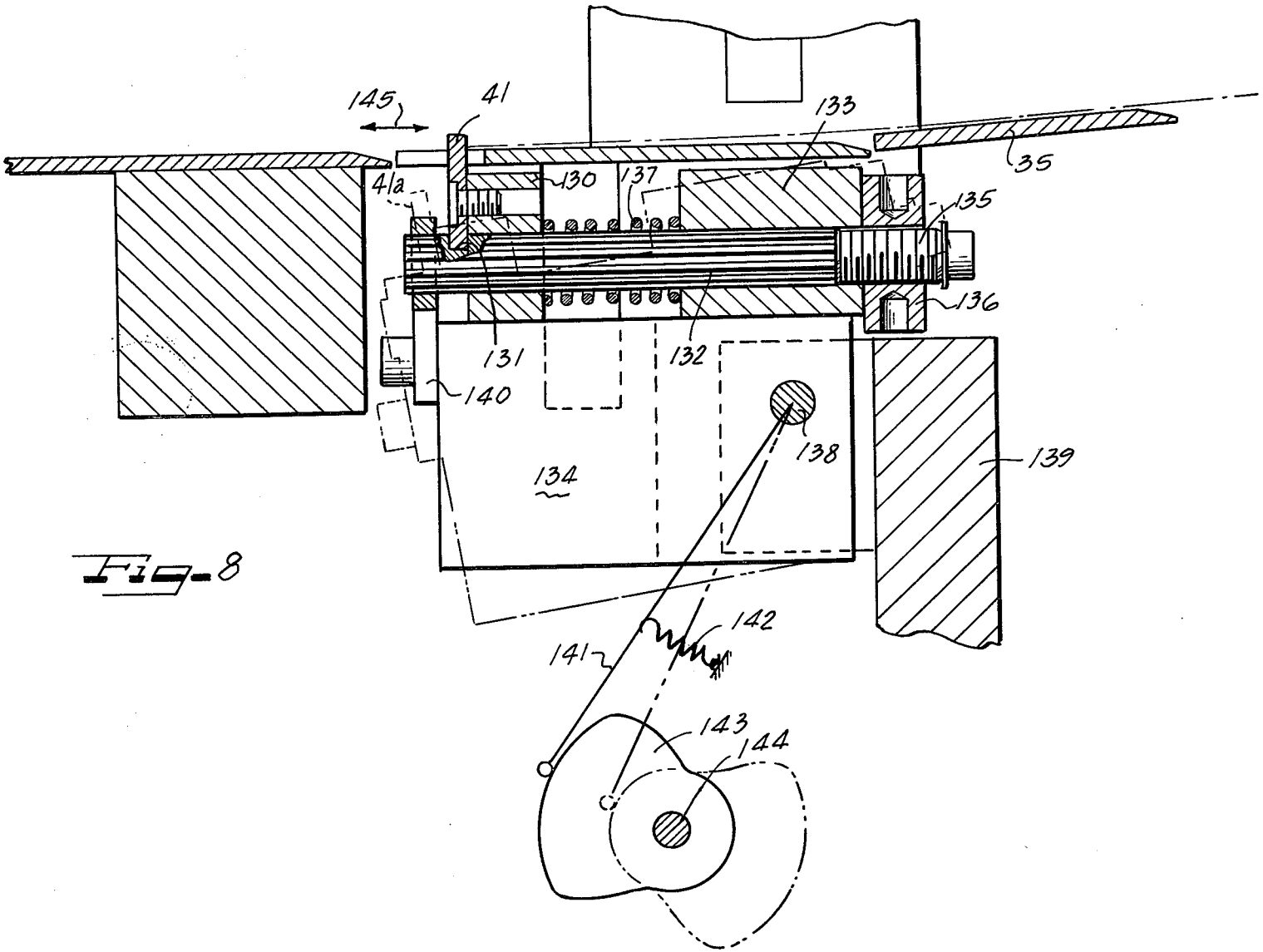
FIG. 8 is a schematic presentation with portions in cross section for purposes of illustration of a forward abutment for positioning the leading edge of a sheet prior to attachment to the band.

As best illustrated in FIG. 8, the forward abutments 41 are positioned to be intermittently moved into and out of the path of a sheet moving on the table 35. To accomplish this, each abutment 41 is detachably connected on a block 130 and has a lower portion received in a slot 131 of a shaft 132. The shaft 132 is slidably supported in a block 133, which is rigidly secured to a lower member 134, and the shaft has a threaded end 135 receiving an adjustment nut or knurled knob 136. A spring 137 is telescopically received about the shaft 132 and is entrapped between the blocks 130 and 133 to bias the block 130 and the stop 41 away from the block 133. The lever member 134 is mounted on a shaft 138, which is supported for rotation by a member attached to a frame member 139 which is located beneath the feed table 35. To guide the shaft, a plate 140 is attached to an end of the lever 134 and slidably receives a free end of the shaft 132.

The shaft 138, which pivotably mounts the member 134 on a frame member 139, is provided with a lever which is schematically illustrated at 141 and which terminates in a follower which is biased by a spring 142 onto a cam surface of a cam 143. The cam 143 is mounted on rotatable shaft 144. When the arm 141 is in the position shown, the abutment 41 is positioned to extend above the level of the feed table 35 to engage a leading edge 39 of a sheet 38. When the cam is moved to the position shown in chain lines, the abutment 41 is retracted to a position **41*a* and enables passage of the sheet along the table over the position of the abutment 41. The nut 136 enables shifting the position of the abutment 41 in a direction of double arrow 145**.

Figure 9:
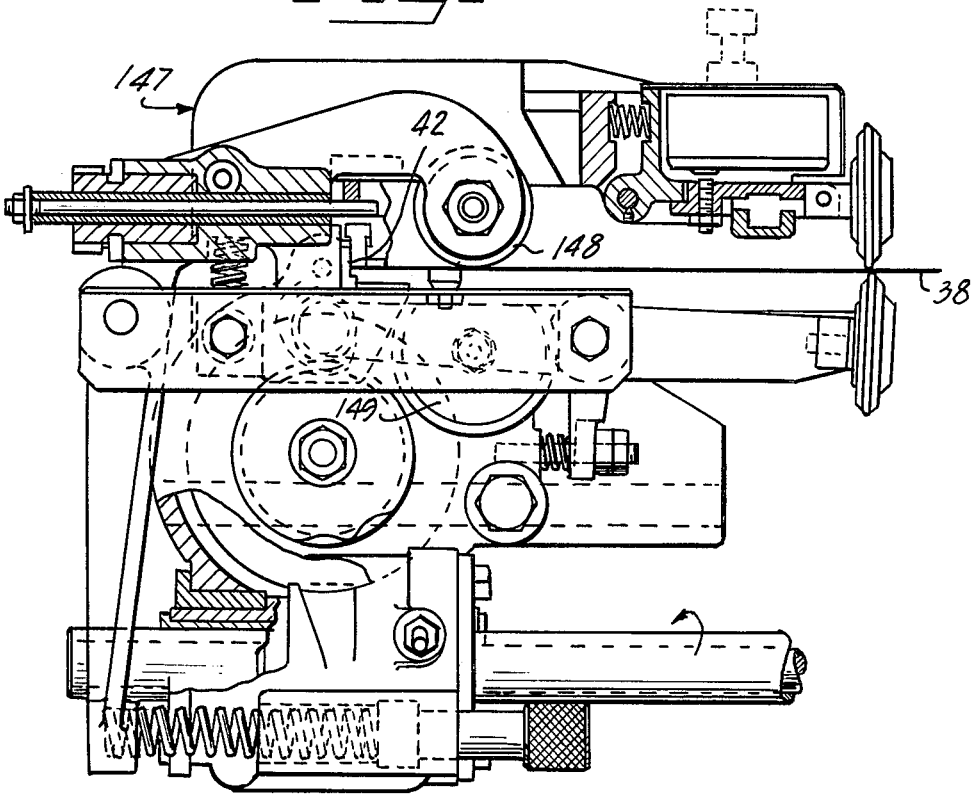
FIG. 9 is a side view showing the lateral holding means for a sheet during the connecting operation.
Figure 10:
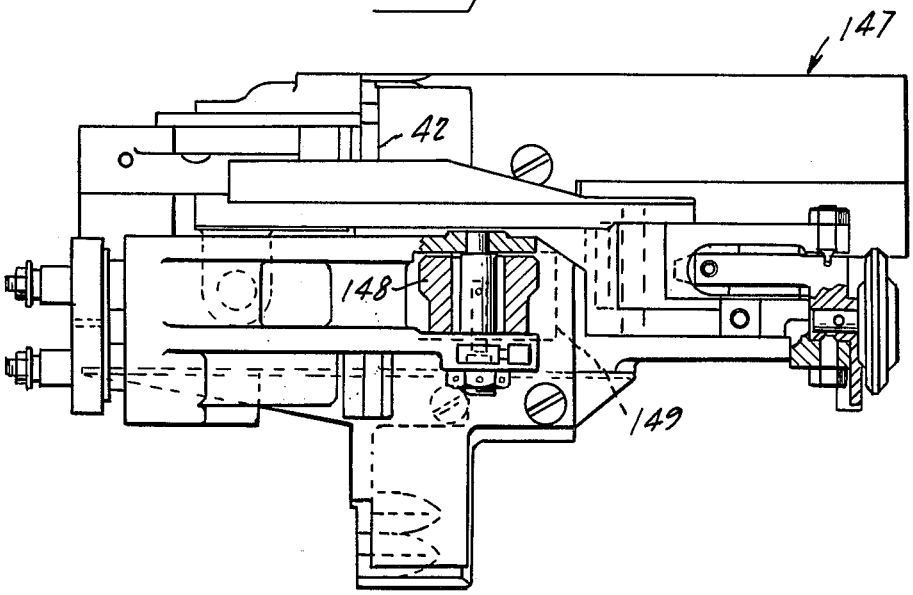
FIG. 10 is a plan view of the device of FIG. 9.

As illustrated in FIG. 1B, the flow 36 of sheets is offset laterally from the band 15. The leading sheet 38 of the flow is moved both forward against abutments 41 and laterally against the abutments 42. To accomplish this, the positioning means includes a conventionally aligning device as illustrated in FIGS. 9 and 10 at 147. The device 147 has a frame and supports the lateral abutment 42. A set of rolls 148 and 149 are provided in the device 147 and are arranged to engage the sheet 38 and move it laterally against the stop or abutment 42. To accomplish this, the roll 149 is continually rotating and the pressure roll 148 is incrementally moved into a pressure engagement with the sheet 38 to shift it laterally into an aligned position against the lateral abutment 42.

In the above discussion, the positioning means positions the forward or leading edge 39 of the leading sheet 38 in alignment with the trailing edge 40 so that the two sheets can be interconnected by the connecting elements 44. It is within the scope of the present invention that the edge 39 is placed in an overlapping relationship with the edge 40 so that the marginal edge portions are in overlapping engagement and so that the connection can be accomplished by deforming the two sheets together such as by a staking process.

To advance the band 15 incrementally, the drive roll 19 coacts with the pressure roll 22, which is mounted on a transverse frame member 159, and the rolls 19 and 22 engage the band 15 and incrementally conveys it in the forward direction through the various stations. To accomplish this, the drive roll 19 is mounted on a shaft and is joined to a spur or pinion gear 160 by a uni-directional connection, such as a conventional one-way clutch, so that rotational movement of the gear 160 only rotates the drive roll 19 in the direction of arrow 161. The pinion gear 160 is in meshing relationship with a sector gear 162, which is mounted for rotations on a shaft 163 and has a lever portion 164 containing a slot 165. To oscillate the sector gear 162 on the shaft 163, a lever 166 keyed to a rotating shaft 167 has a pivotably connected slide block 168 received in the slot 165. As the lever 166 rotates in the direction of the arrow 169, the block 168 moves in the slide 165 and causes movement of the sector gear in the direction of arrow 170 about its shaft 163.

During such movement and due to the uni-directional connection between the pinion 160 and drive roll 19, the roll remains stationary and if desired a brake device may be provided to prevent rotation of the roll 19. After the slide block 168 has been carried through the lowest point of travel, the sector gear 162 is rotated in a clockwise direction opposite the arrow 170 and this movement is transferred to the pinion 160 and the drive roll 19 to advance the band through the various stations. If a brake device is utilized, it must be released as the sector gear 162 moves in the direction opposite to the arrow 170. In order to adjust the arcuate segment of the rotation for the sector gear 162, the slide block 168 is adjustably mounted along a radial slot 171 of the lever 166.

The drive roll 19 is positioned at the inlet end of the press 11. Due to movement of the lower platen 30 during a die cutting operation, the band 15 of sheets is shifted from a substantially horizontal plane to an inclined plane or path as the lower platen is reciprocated against the upper platen 29. To provide support, a movable support table 173 is supported at one end by a link or hinge connection 174 to the platen 30. The other end adjacent to the drive roll 19 is supported by a hinged linkage having links 176, 177 which linkage is connected to a shaft 175 attached to the frame of the machine. During an upper movement of the lower platen 30 from the position illustrated in FIG. 7, the table 173 is free to shift from a substantially horizontal plane to an inclined relationship.

Figure 11:
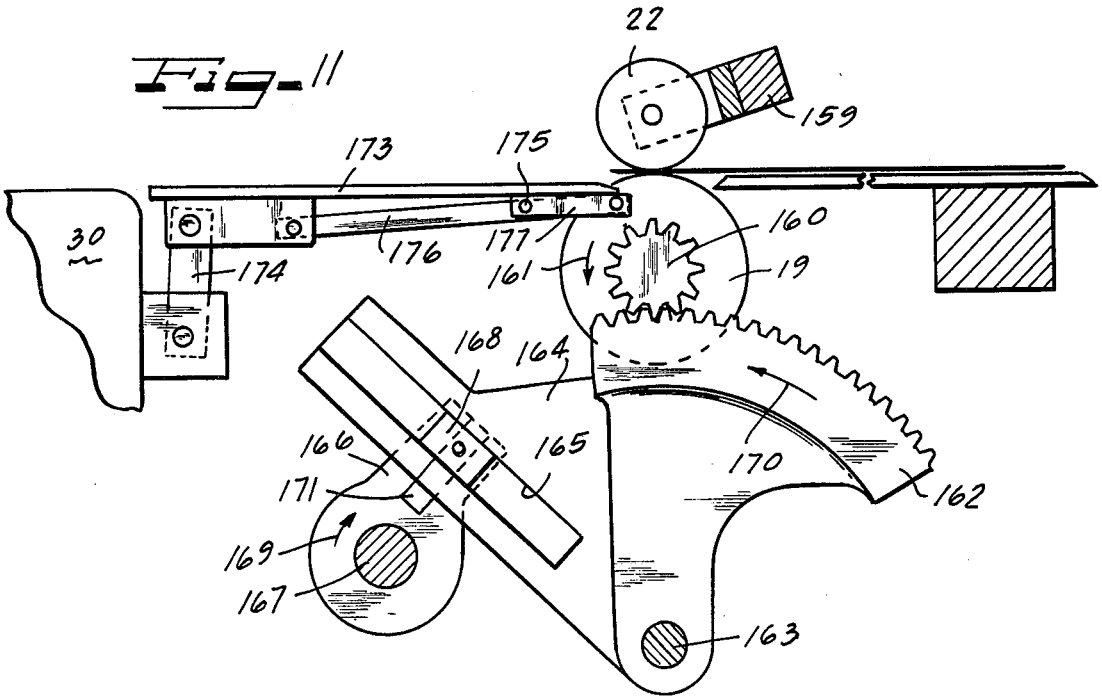
FIG. 11 is a side view with portions removed for purposes of illustration of a device for incrementally advancing the band of sheets.
Figure 12:
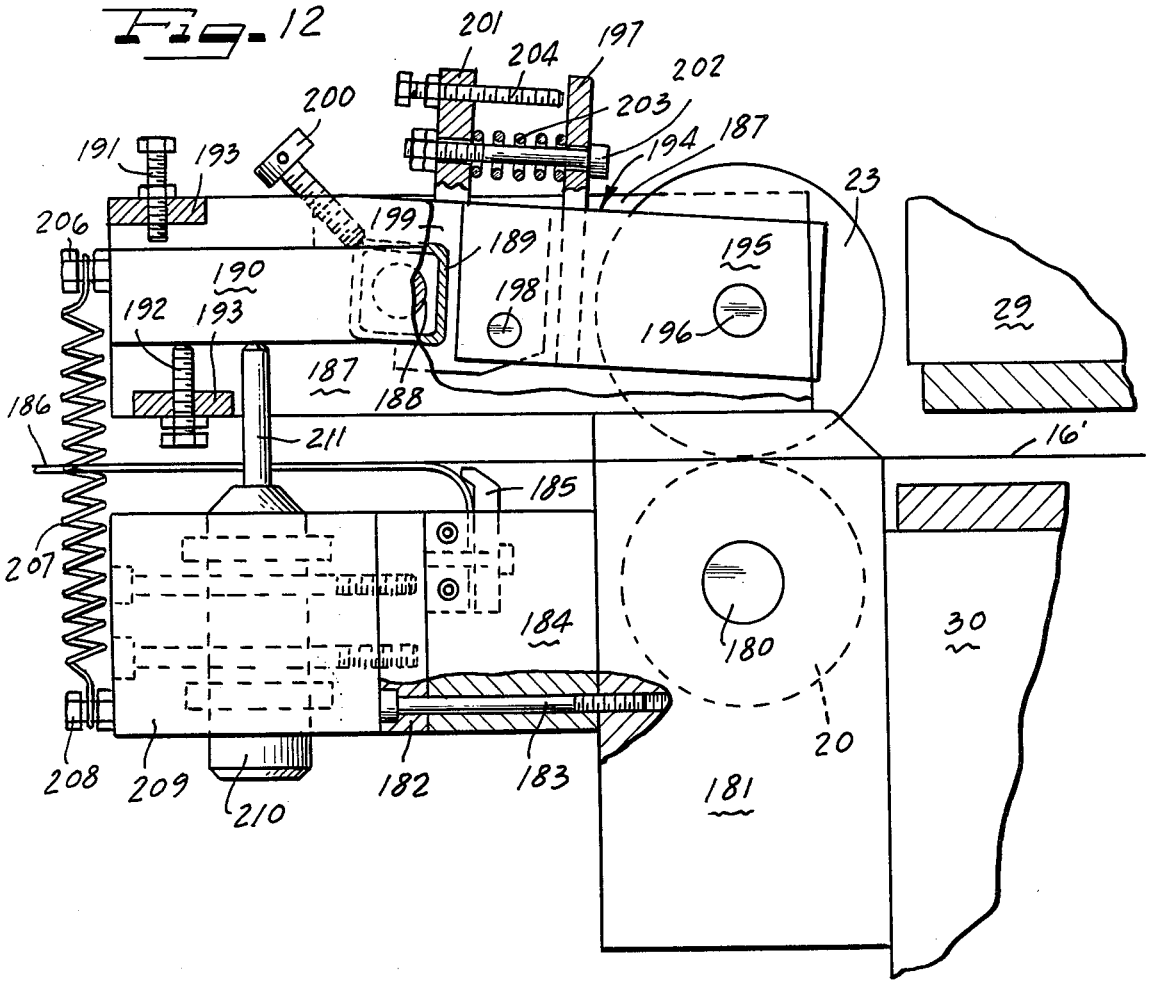
FIG. 12 is a side view with portions broken away and in cross section for purposes of illustration of means for applying a tension to the sheet disposed between the platens.

To maintain tension on the sheet such as 16' disposed between the platens 29 and 30 for die cutting, the drive roll 20 and coacting pressure roll 23 are mounted on the outlet side of the platen press. As illustrated in FIG. 11, the drive roll 20 is mounted on a shaft 180 which is rotatably supported on a pair of spaced support members 181, which are rigidly attached to the lower platen 30. A transverse member 182 is connected, such as by machine screws 183, to the spaced supports 181 and spaced therefrom by spacing members 184. Mounted on the transverse member 182 is a clamp 185, which receives one end of a flexible web or belt 186, which extends from the press to the stripper station 12.

On the upper end of each of the support members 181, an arm member 187 is rigidly mounted. The member 187 may be attached by welding or be an integral portion of the member 181. Each of the arm members 187 has an aperture for receiving a cylindrical end 188 of a transverse member 189, that extends between the member 187. As illustrated, the transverse member 189 has a substantially rectangular or square cross section. One of the ends 188 is connected to a lever arm 190, which is received between an upper abutment 191 and a lower abutment 192. The abutments 191, 192 are adjustably carried in spaced ears or tabs 193 extending from the member 187.

Adjustably connected on the square member 189 between the members 187, 187 is a support 194 for each of the pressure rolls 23. Each support 194 has a yoke formed by a pair of spaced members 195, which rotatably support a shaft 196 for the pressure roll 23. The yoke includes an upstanding member 197 and is pivotably connected at 198 to a fixed member 199. The fixed member 199 has a slot, which receives the square portion of the transverse member 189. To insure a secure attachment of the member 199 on the member 189, the member 199 is provided with a threaded member 200 to clamp the fixed portion 199 on the transverse member 189. The fixed member 199 has an upstanding portion or tab 201, which coacts with the upstanding portion 197 to allow controlled pivotable movement of the yoke relative to the fixed member 199. To accomplish this, a bolt 222 is loosely received in the apertures in the members 197 and 201 and has a spring 203, which urges the yoke in a clockwise direction about the pivot point 198 with the amount of movement being limited by the bolt 202. To limit the amount of movement in the counterclockwise direction, and adjustable abutment 204 is provided on the member 199.

The arm 190 has an anchor 206, which receives one end of a spring 207 whose other end is connected to an anchor 208 provided on a member 209, which is detachably connected to the transverse member 182. The member 209 supports an actuating means 210, such as pneumatic cylinder, which has a ram 211 engaging the arm 190. When the actuator 210 is disengaged or deenergized, the arm 190 rests on the lower abutment 192 due to the tension of the spring 207. With actuation of the actuator 210, the arm 190 is shifted to engage the upper abutment 191 and causes rotation in a clockwise direction of the member 189 and therefore the fixed member 199 of each of the mounting structures 194. This clockwise direction of rotation increases the pressure applied on each of the pressure rolls 23. With the increased pressure applied by the roll 23 on the band 15 disposed between it and the drive roll 20, which is continually operating, a high acceleration is applied to the band 15 to transport it in the direction toward the next station, such as a stripping station 12. When the arm 190 returns to the abutment 192, the pressure applied by the support structure 194 to each of the pressure rolls 23 is decreased to decrease the gripping of the band 15 and decrease the acceleration of the movement of the band therethrough. Thus, with the lower pressure level, slippage between the band 15 and the drive roll 20 will occur particularly when the drive roll 19 is in a stationary position. However, the slippage that occurs during a lower acceleration condition, maintains tension on the blank such as 16' to insure registry with the particular pattern of die cutting knives and creasing bars contained in the platen press 11. Control of the actuator 210, which could also utilize a solenoid, is proportional to the acceleration of the band 15 and is linked to movement of the drive roll 19 so that as the drive roll 19 begins to rotate in the direction 161, the actuator 210 shifts the lever 190 to apply greater pressure on each of the pressure rolls 23 to increase the acceleration applied by the continuously rotating drive roll 20.

Figure 13:
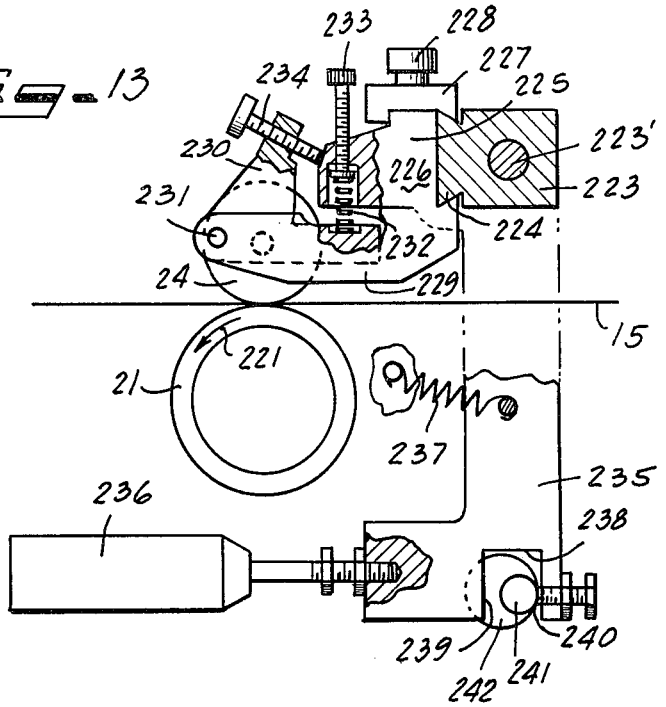
FIG. 13 illustrates the actuating means for moving the band into the separating means.
Figure 14:
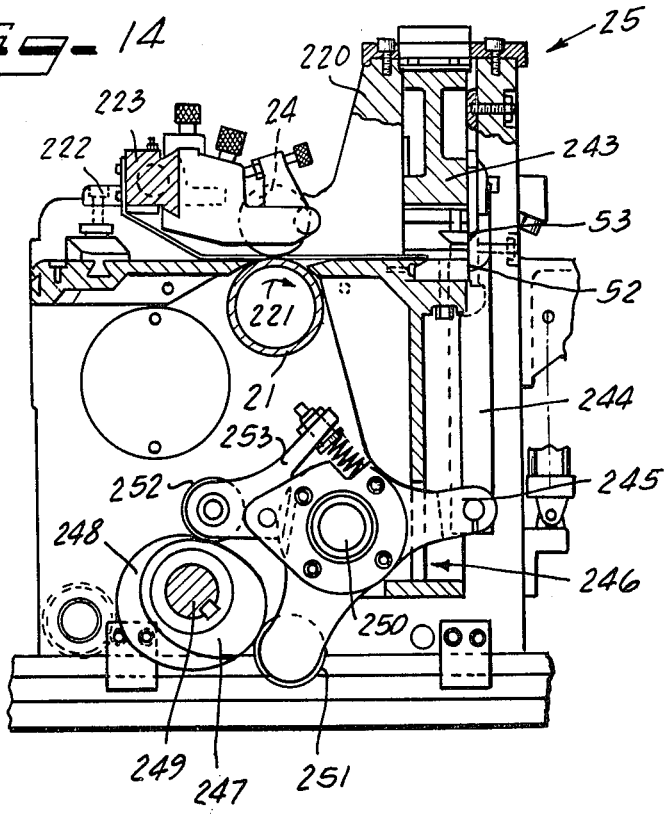
FIG. 14 is a partial cross section of the separating means.

As schematically illustrated in FIG. 1A, each sheet 16 of the band 15 after passing between or through the stripping station 12 is received by a separating means such as a guillotine 25 which has a fixed knife 52 and a movable knife 53. The guillotine or separating means 25 includes a band conveying means having the drive roll 21 and the pressure roll 24. The roll 21 (as illustrated in FIG. 14) is supported in a housing 220 of the separating means 25 and is connected to means (not illustrated) for continually rotating the roll 21 in the direction of arrow 221. The housing 220 has bearing pads 222 for rotatably supporting cylindrical ends of a transverse member 223, which has a keystone-type wedge structure 224 best illustrated in FIG. 13.

To support each of the pressure rolls 24 on the transverse member 223, a support structure 225 is provided. The support structure 225 has a fixed member 226 having a surface coacting with a locking plate 227 to grip the keystone structure 224 of the transverse support 223. The locking plate 227 is held in place by an adjustable fastener, such as 228. The member 226 has a pair of spaced arms 229, which extend rearwardly, as illustrated in FIG. 13. The pair of arms 229 receive a second member 230, which rotatably mounts the pressure roll 24. The second member 230 is pivotably connected to the arms 229 by a shaft or pin 231 so that the axis of the roll 24 can move eccentrically around the mounting pin 231. A spring 232, whose tension is adjustable by adjustment means 233, urges or biases the member 230 in a clockwise direction around the pivot point 231. The movement in the clockwise direction of the member 230 is controlled by an adjustable stop 234 which is carried on the member 230.

The support 223 is keyed to an arm 235, which is connected to an actuator 236. The actuator 236, which can be either a pneumatic cylinder or a solenoid, rotates the arm 235 in a counterclockwise direction against a biasing force provided by a spring 237 to cause an increase in the pressure being applied by the pressure roll 24. To control the amount of movement of the arm 235, it has a slot 238 to provide an abutment surface 239 and an adjustable abutment surface 240 formed by a threaded fastener. The abutment surfaces 239 and 240 contact a pin 241 to limit movement of the arm 235. As illustrated, the pin 241 is eccentrically mounted on a rod 242, so that the position of the pin 241 relative to the axis 223' of the member 223 can be shifted by rotating the eccentric pin 241 on the axis of the rod 242.

With the arm 235 in the position illustrated in FIG. 13, the pressure applied by roll 24 is at a minimum and the coaction of drive roll 21 and pressure roll 24 will produce a low acceleration on the band 15. This is the condition which occurs as the band 15 is being decelerated to a stationary condition for operation of the guillotine 25. When the arm 235 has been shifted so that the abutment 239 engages the pin 241, the support structure 225 is rotated above the axis 223' to increase the pressure being applied by the roll 24. In this relationship, which occurs during acceleration of the band 15 from a standing condition, the drive roll 21 and pressure roll 24 coact to convey the band 15.

The fixed knife 52 is rigidly mounted in the housing 220 and coacts with the movable knife 53, which is secured to a movable transverse member 243. The member 243 is reciprocated in a vertical sideway by a rod 244, which is connected to an arm 245 of a cam drive 246. The cam drive has a first cam 247 and a second cam 248 keyed to a rotating shaft 249. The arm 245 is part of a mechanism, which is mounted on a rotatable shaft 250 and which includes a first cam follower 251 and a second cam follower 252. The first cam follower 251 engages the cam surface of cam 247 and the second follower 252, which is carried on a spring biased lever 253, engages the surface of the second cam 248. The spring biased lever 253 insures a contact between the followers and their respective cam surfaces. Due to the coaction of the cam drive mechanism 246, the rod 244 reciprocates the transverse beam 243 and the movable knife 53 into cutting cooperation with the fixed knife 52 to sever connecting elements which attach the blanks 16''' to the band 15.

Figure 2:
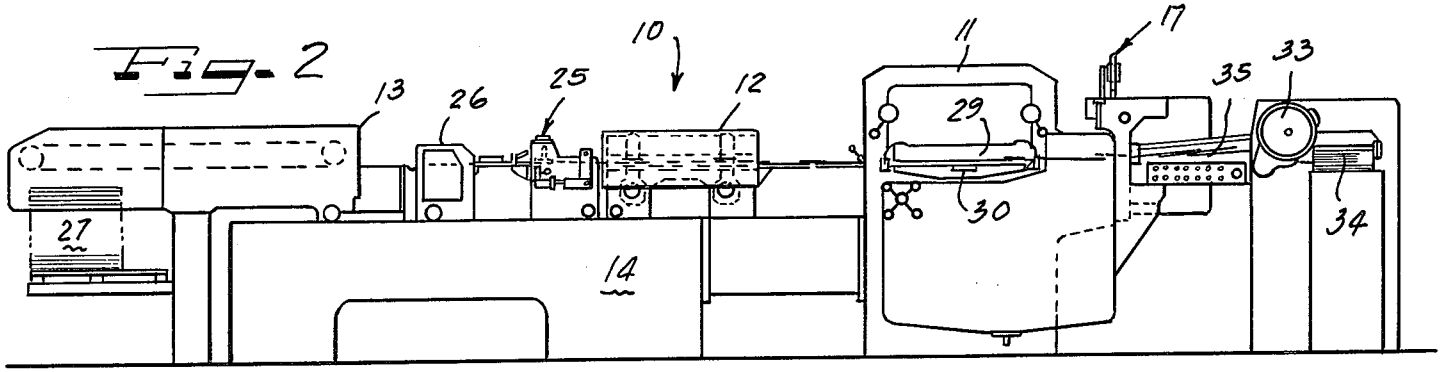
FIG. 2 is a side view of an apparatus according to the present invention.
Figure 15:
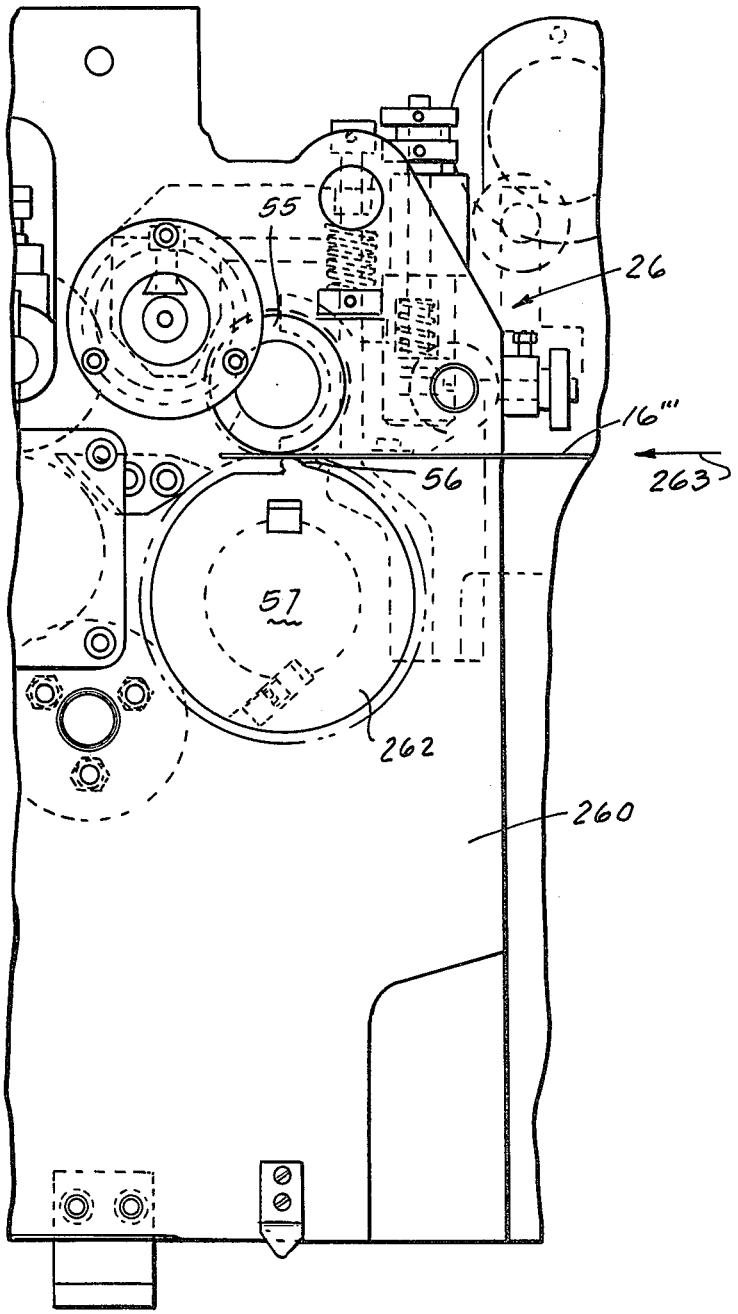
FIG. 15 is a partial cross-sectional view of the means for transferring the separated sheets.

As best illustrated in FIG. 1A, the band 16''', when severed by the knives 52 and 52, has its leading end inserted between a roll 55 and an arcuate segment 56 which are portions of the transporting means 26 of FIG. 2. As best illustrated in FIG. 15, the roll 55 and the shaft 57 are mounted for rotation in a housing 260 of the transporting means 26. Means are provided to continually rotate the shaft 57, which support a cylindrical sleeve 262 that has been machined to provide a small segment 56 of a sufficient radius to grip a sheet 16''' extending between the segment 56 and the roll 55. When the segment 56 moves into engagement with the sheet 16''', it will kick the sheet forward in a direction of arrow 263 into the delivery station 13.

The rotation of shafts 57, 144, 167, 180 and 249 is accomplished by a drive train from the main source of rotation which also operates the press 11 and stripping station 12. Thus, the desired timing of the operation of the various stations is easily obtained. The timing of the operation of the actuators 210 and 236 with the movement of the drive roll 19 can be accomplished by using appropriate timing mechanisms, such as a control valve which is operated by a cam mounted on the shaft 167. In a similar manner, the reciprocating movement of the bars 92 can be accomplished by an eccentric drive from the main drive train or by separate actuators with appropriate controls.

In the above described embodiment which is schematically illustrated in FIGS. 1A and 1B, each of the units such as stripping station 12, the separating means or guillotine 25, the transporting means 26, can be adjustably positioned on the frame 14 to compensate for changes in the length of the sheets such as 16.

Figure 16A:
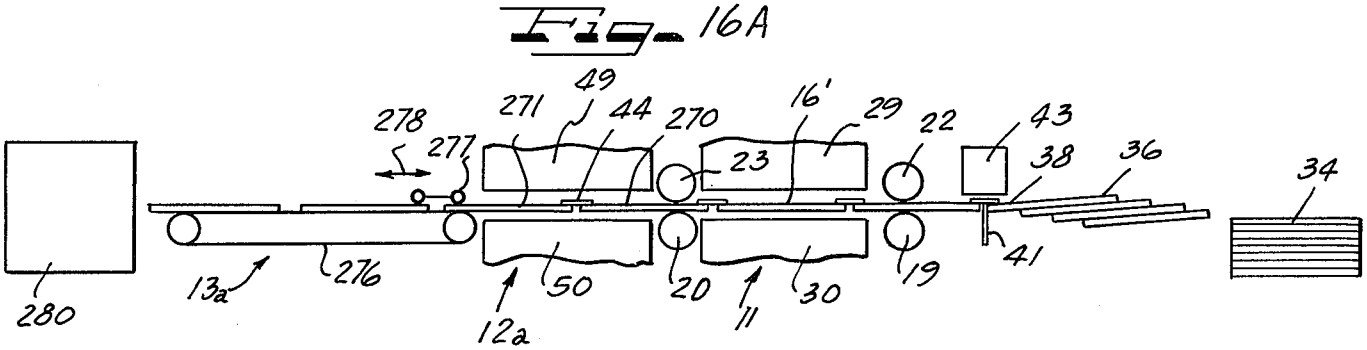
FIGS. 16A and 16B are schematic illustrations of a second embodiment of the present invention.
Figure 16B:
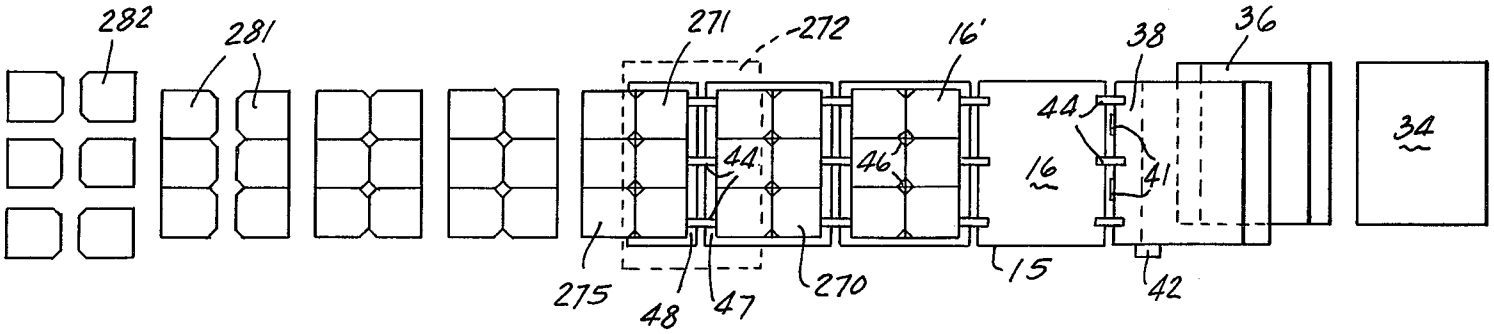

In FIGS. 16A and 16B, a schematic presentation of an embodiment of the present invention is illustrated. Like element numbers are used to identify like portions and the major difference of the embodiment, which illustrated in FIGS. 16A and 16B, is the incorporation of the separating means into the stripping station which is identified at **12*a*. As in the previous embodiment, sheets from a stack 34 are formed in a shingled overlapping flow 36 with the leading sheet 38 positioned adjacent to the band 15. The aligned sheet 38 is connected or attached to the band by connecting elements 44 and then incrementally conveyed by the drive roll 19 between the platens 29 and 30 of the press 11. When the band 15 is in a dwell period, it is maintained under a tension by the action of the drive roll 20 and pressure roll 23**.

The stripping device or station **12*a* is positioned adjacent to the output of the drive roll 20 so that the portion of the sheet identified by element number 270 extends between the members 49 and 50 of the stripping station 12*a*. As illustrated, the members 49 and 50 are positioned to also receive a rear portion of the sheet 271. Thus, an operation of the stripping station 12*a*, an area enclosed in broken lines and identified as 272 is stripped of all waste portions including the waste portions 46 between the individual blanks and the marginal edge waste portions 47 and 48 including the connecting elements 44**.

With the removal of all waste portions including the edge portions 47 and 48, the blank 271 is separated from the band 15, and a leading end portion 275 extends on a conveyor 276. To aid in pulling the separated blanks onto the conveyor 276, which is a delivery station **13*a*, a pressure roll 277 is provided. The roll 277 may be carried on a reciprocating structure which moves the roll in the direction of arrow 278 between a position withdrawn from the sheet 271 prior to stripping to a position engaging the portion 275** after stripping.

The delivery station **13*a* may deposit the stripped blanks in a stack or transport the sheets to means 280 for further processing the blanks of the sheet. The means 280 can be an apparatus for separating and stacking blanks such as disclosed in U.S. patent application No. 337,656, which was filed by George Meylan on Mar. 2, 1973 and issued as U.S. Pat. No. 3,870,213 on Mar. 11, 1975. Briefly, the device separates the blanks into transverse extending rows 281 of blanks and then separates the blanks of each transverse row 281 to provide individual blanks 282 which are then deposited in individual stacks according to the blank's original registry position in the die cut sheet. If desired, the means 280** may be of a type of separating device which separates the blanks and then deposits them in a stack regardless of their original registry position in the die cut sheet.

The embodiment of 16A could utilize a delivery station 13 in place of the station **13*a*. In a similar manner, the device 10 of FIG. 2** could be used in conjunction with the stacking and separating device if desired.

Although various minor modifications may be suggested by those versed in the art, it should be understood that I wish to employ within the scope of the patent granted hereon, all such modifications as reasonably and properly come within the scope of my contribution to the art.

I claim:

1. A method of die cutting at least one blank in a sheet of material with a platen press and subsequently removing waste material from the die cut sheet comprising forming a band of sheets with the leading edge of each sheet connected to the trailing edge of the preceding sheet, conveying the band of sheets between the platens of the platen press with a dwell period to position each sheet of the band sequentially at the platens, sequentially die cutting each sheet positioned between the platens of the press, conveying the band with the die cut sheets through a stripping station, stripping waste from the die cut sheets during a dwell in the movement of the band and separating each of the sheets from the band for subsequent handling so that the conveying of the band of sheets intermittently advances a sheet in the band through the platen press for die cutting and then through a stripping station prior to delivery of the individual sheet for subsequent handling and processing.

2. A method according to claim 1, wherein the step of separating is simultaneously performed with the step of stripping waste from the sheet.

3. A method according to claim 1, wherein the step of separating is performed sequentially to the step of stripping waste from the die cut sheet.

4. A method according to claim 1, wherein the step of forming a band includes the steps of creating a flow of individual sheets in an overlapping shingled relationship, positioning the leading edge of the leading sheet of the flow in alignment with the trailing edge of the last sheet in the band, and interconnecting the aligned sheet to the band to sequentially add the sheet thereto.

5. A method according to claim 4, wherein the step of interconnecting the aligned sheet comprises taping the leading aligned edge to the trailng edge of the band.

6. A method according to claim 4, wherein the step of interconnecting the aligned sheet comprises stapling the aligned leading edge to the trailing edge of the band.

7. A method according to claim 4, wherein the step of positioning includes superimposing the leading and trailing edges of the adjacent sheets and the step of interconnecting comprises simultaneously deforming the superimposed edges together.

8. A method of die cutting at least one blank in a sheet of material with a platen press and subsequently removing waste material from the die cut sheet, the method comprising the steps of removing sheets sequentially from a pile of sheets, creating a flow of the removed sheets in an overlapping shingled relationship, sequentially positioning the leading edge of the leading sheet of the flow with the trailing edge of the next preceeding sheet, sequentially interconnecting the positioned edges to create a web of interconnected sheets, intermittently conveying the web of interconnected sheets to sequentially position each sheet of the web in the platen press and then a stripping station, die cutting each of the sheets of the web sequentially positioned at the platen press, stripping waste from each of the die cut sheets of the web sequentially positioned at the stripping station, and separating each of the stripped sheets from the web for subsequent handling so that the conveying of the web of sheets intermittently advances the sheets of the web through the platen press for die cutting and then through the stripping station prior to separation for subsequent handling and processing.

9. A method according to claim 8, which after the step of separating the stripped sheets from the web includes separating the blanks of the individual separated sheets and delivering the separated blanks into piles in accordance to their registry position in the die cut sheet.

10. A method according to claim 8, which after the step of separating the stripped sheets from the web includes separating the blanks of each of the separated stripped sheets and piling the separated blanks in any order.

11. A method according to claim 8, which after the step of separating the stripped sheets from the web includes separating the blanks of each of the separated stripped sheets and delivering the blanks as a stream.

12. An apparatus for die cutting at least one blank in a sheet of material with a platen press and subsequently removing waste material from the die cut sheet comprising a platen press having a pair of platens, a stripping station, and delivery station all aligned to successively perform their respective operations on a sheet of material transported therebetween, means for forming a band of interconnected sheets with the leading edge of each sheet connected to the trailing edge of the preceeding sheet, means for conveying the band of sheets intermittently through the platen press and the stripping station with a dwell period to enable the die cutting of each sheet positioned between the platen and stripping waste from a die cut sheet positioned at the stripping station and means for subsequently separating each sheet from the band prior to being received by the delivery station so that each sheet of the band is sequentially die cut, stripped and then separated for further handling.

13. An apparatus according to claim 12, wherein said means for conveying includes means for maintaining a tension on a sheet of the band disposed between the platens during each dwell period.

14. An apparatus according to claim 13, wherein the means for maintaining a tension includes a pair of rolls, one of said pair of rolls being a drive roll which is rotated at a continuous speed and the other of said pair of rolls acting as a pressure roll and means varying the pressure applied by said pressure roll on a sheet disposed between the pair of rolls so that during a dwell period, the pressure exerted by the pressure roll is sufficient to cause the drive roll to apply a tension to a sheet engaged thereby and during conveying the pressure roll exerts sufficient pressure to cause conveying of said band.

15. An apparatus according to claim 12, wherein the means for intermittently moving the band of sheets through the apparatus includes a pair of rolls for engaging opposite sides of a sheet disposed therebetween, one of said rolls being a drive roll connected by a one-way clutch to a pinion gear, a sector gear in meshing relation with the pinion gear, and means oscillating the sector gear through a given arc so that during one direction of movement of the sector gear through the arc, the drive roll advances the band of sheets engaged by a pair of rolls a given distance and during an opposite direction of movement of the sector gear through the arc, the drive roll remains stationary to impose the dwell period on the movement of the band.

16. An apparatus according to claim 15, wherein the means oscillating the sector gear includes means for varying the arcuate distance of the movement to enable changing the amount of advancement of the band by the drive roll.

17. An apparatus according to claim 15, wherein the pair of rolls are disposed at an inlet side of the platen press and which conveying means further means disposed at the outlet side of the press for applying a continuous tension on a sheet disposed between the platens of the press.

18. An apparatus according to claim 17, wherein the means for applying a continuous tension comprises a second drive roll and a second pressure roll for receiving a sheet therebetween, means for continuously rotating the second drive roll and means for changing the amount of pressure exerted by the second pressure roll from a minimum pressure to a maximum pressure so that during a dwell period of the first-mentioned drive roll, the second pressure roll applies a minimum pressure on a blank disposed between the second rolls of the tension means to coact with the first-mentioned drive roll to apply a tension on the sheet disposed between the platen of the press.

19. An apparatus according to claim 12, wherein said means for separating is disposed in the stripping station so that a sheet is separated and stripped simultaneously.

20. An apparatus according to claim 12, wherein the means for separating comprises a fixed knife spaced from the discharge end of the stripping station and a movable knife coacting with the fixed knife and movable during actuation of the platen presses to sever a stripped sheet from the band of sheets.

21. An apparatus according to claim 12, wherein the means for forming the band includes means creating a flow of individual sheets in overlapping shinged relationship, means for positioning a leading edge of a leading sheet of the flow in alignment with the trailing edge of the last sheet in the band and means for interconnecting the aligned sheet to the band to sequentially add the sheet thereto.

22. An apparatus according to claim 21, wherein the means for positioning is operable during a dwell in the advancement of the band of sheets.

23. An apparatus according to claim 22, wherein the means for positioning includes at least one lateral abutment and at least two retractable leading edge abutment and means for moving the leading sheet of the flow laterally and forward into engagement with said abutments.

24. An apparatus according to claim 21, wherein the means for interconnecting applies a connecting element engaging the pair of aligned edges.

25. An apparatus according to claim 24, wherein the connecting element is a tape and wherein the means for interconnecting includes means for cutting a predetermined length of tape and pressing the tape onto the aligned edges.

26. In an apparatus for die cutting at least one blank in a sheet of material with a platen press and subsequently removing waste material from the die cut sheet, said apparatus having a feeding means for providing the sheets in an overlapping shingled flow onto a feed table, a die cutting station for receiving sheets from the feed table, a stripping station for stripping die cut sheets from the die cutting station and a delivery station for receiving the stripped die cut sheets, the improvements comprising means for positioning the leading sheet of the flow with its leading edge aligned with the trailing edge of a preceeding sheet; means for interconnecting the aligned edges to form a web of interconnected sheets; means for intermittently conveying the web of interconnected sheets; each of said means for positioning, said means for interconnecting, and said means for intermittently conveying being disposed between the means providing the sheet in a flow and an inlet of the die cuttng station with the means for intermittently conveying being adjacent said inlet, means for continuous conveying the web located at an outlet of said die cutting station, said means for continuously conveying coacting with the means for intermittently conveying to tension the sheet of the web disposed in the die cutting station; means disposed adjacent an outlet of a stripping station for disassembling the sheet from the web so that as means for intermittently conveying moves the web sheets through the die cutting station and stripping station, the means for positioning and the means for interconnecting sequentially add sheets to the last sheet of a web and the means for disassembling subsequently separate the leading sheet from the web for subsequent handling.

27. In an apparatus according to claim 26, wherein the means for positioning includes at least one lateral stop and at least one retractable front stop and means for shifting a leading sheet of the flow against said stops.

28. In an apparatus according to claim 26, wherein the means for disassembling is disposed within the stripping station.

29. In an apparatus according to claim 26, wherein the means for disassembling is spaced in the direction of movement of the web from the stripping station and includes a movable knife and a fixed counter knife.

30. In an apparatus according to claim 26, wherein the means for continuously conveying of the die cut web consists of a continuously rotating roller, at least one pressure roller coacting with the continuous roller to form at least a pair of roller surfaces engaging the web and means for varying the pressure of the pressure roller against the web.

31. In an apparatus according to claim 26, wherein the means for intermittently conveying includes a drive roll engaging the web, a pinion gear connected by a one-way clutch to the drive roll, a toothed sector gear in meshing engagement with the pinion and an eccentric oscillating the sector gear.

32. In an apparatus according to claim 31, wherein the length of the eccentric is adjustable to vary the amount of oscillation of the sector gear.

* * * * *